US011753057B2

(12) United States Patent
Honeck et al.

(10) Patent No.: US 11,753,057 B2
(45) Date of Patent: Sep. 12, 2023

(54) SYSTEMS AND METHODS FOR SIGNAL LIGHTS OF TRAFFIC GATES

(71) Applicant: Railway Equipment Company, Inc., Minneapolis, MN (US)

(72) Inventors: Randall Gene Honeck, Maple Grove, MN (US); Jason Lee Honeck, Maple Grove, MN (US); Haozhi Ding, Plymouth, MN (US)

(73) Assignee: Railway Equipment Company, Inc., Minneapolis, MN (US)

( * ) Notice: Subject to any disclaimer, the term of this patent is extended or adjusted under 35 U.S.C. 154(b) by 361 days.

(21) Appl. No.: 17/025,099

(22) Filed: Sep. 18, 2020

(65) Prior Publication Data

US 2021/0086809 A1 Mar. 25, 2021

Related U.S. Application Data

(60) Provisional application No. 62/903,348, filed on Sep. 20, 2019.

(51) Int. Cl.
*B61L 29/22* (2006.01)
*B61L 29/30* (2006.01)

(52) U.S. Cl.
CPC ..... *B61L 29/22* (2013.01); *B61L 29/30* (2013.01)

(58) Field of Classification Search
CPC ..... B61L 29/00; B61L 29/02; B61L 29/08; B61L 29/16; B61L 29/22; B61L 29/222; B61L 29/24; B61L 29/28; B61L 29/288; B61L 29/30
See application file for complete search history.

(56) References Cited

FOREIGN PATENT DOCUMENTS

CA 2642386 A1 * 4/2009 ..... B61L 29/08

OTHER PUBLICATIONS

"Canadian Application Serial No. 3,093,604, Response filed Jan. 31, 2022 to Office Action dated Nov. 1, 2021", 7 pgs.
"Canadian Application Serial No. 3,093,604, Non Final Office Action dated May 19, 2022", 3 pgs.
"Canadian Application Serial No. 3,093,604, Office Action dated Nov. 1, 2021", 4 pgs.
"Canadian Application Serial No. 3,093,604, Response filed Aug. 16, 2022 to Non Final Office Action dated May 19, 2022", 17 pgs.
(Continued)

*Primary Examiner* — Robert J McCarry, Jr.
(74) *Attorney, Agent, or Firm* — Schwegman Lundberg & Woessner, P.A.

(57) ABSTRACT

A system can include a signal light for regulating traffic, a controller, a first communication module configured to electronically communicate with the controller, a memory and two or more position sensors coupled to the signal light is disclosed. The two or more position sensors comprise at least a first position sensor configured to detect a first position of the signal light according to a first measurable criteria and a second position sensor configured to detect a second position of the signal light according to a second measurable criteria. The memory configured to selectively store as a reference, desired position data. The controller can be configured to electronically communicate with the two or more position sensors to receive an updated data regarding the first position and the second position and is configured to compare the updated data to the desired position data.

18 Claims, 5 Drawing Sheets

(56) References Cited

OTHER PUBLICATIONS

"Canadian Application Serial No. 3,093,604, Examiner's Rule 86(2) Requisition dated Nov. 21, 2022", 3 pgs.
"Canadian Application Serial No. 3,093,604, Response filed Nov. 25, 2022 to Examiner's Rule 86(2) Requisition dated Nov. 21, 2022", 7 pgs.

* cited by examiner

SYSTEMS AND METHODS FOR SIGNAL LIGHTS OF TRAFFIC GATES

PRIORITY APPLICATION

This application claims priority to U. S. Provisional Application Ser. No. 62/903,348, filed Sep. 20, 2019, the disclosure of which is incorporated herein in its entirety by reference.

TECHNICAL FIELD

The present subject matter relates, in general, to signal lights for traffic gates such as railway crossing gates, and in particular, to position sensing of such signal lights.

BACKGROUND

Traffic support personnel such as those from a state's Department of Transportation (DoT) utilize traffic gates to regulate traffic flow including flow of High Occupancy Vehicles (HOV) also called carpool lanes. Railways also employ railway support personnel to maintain and regulate railway crossing guards and associated signal lights. Both DoT and railways expend considerable resources in operating, monitoring, and troubleshooting traffic gates. For example, currently, most railroad traffic gates are controlled through manipulation of control systems physically coupled to the crossing gates under such control. Personnel must periodically inspect traffic gates, associated signal lights and such control systems to make sure they are in good working order.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION OF THE DRAWINGS

Figure 1:
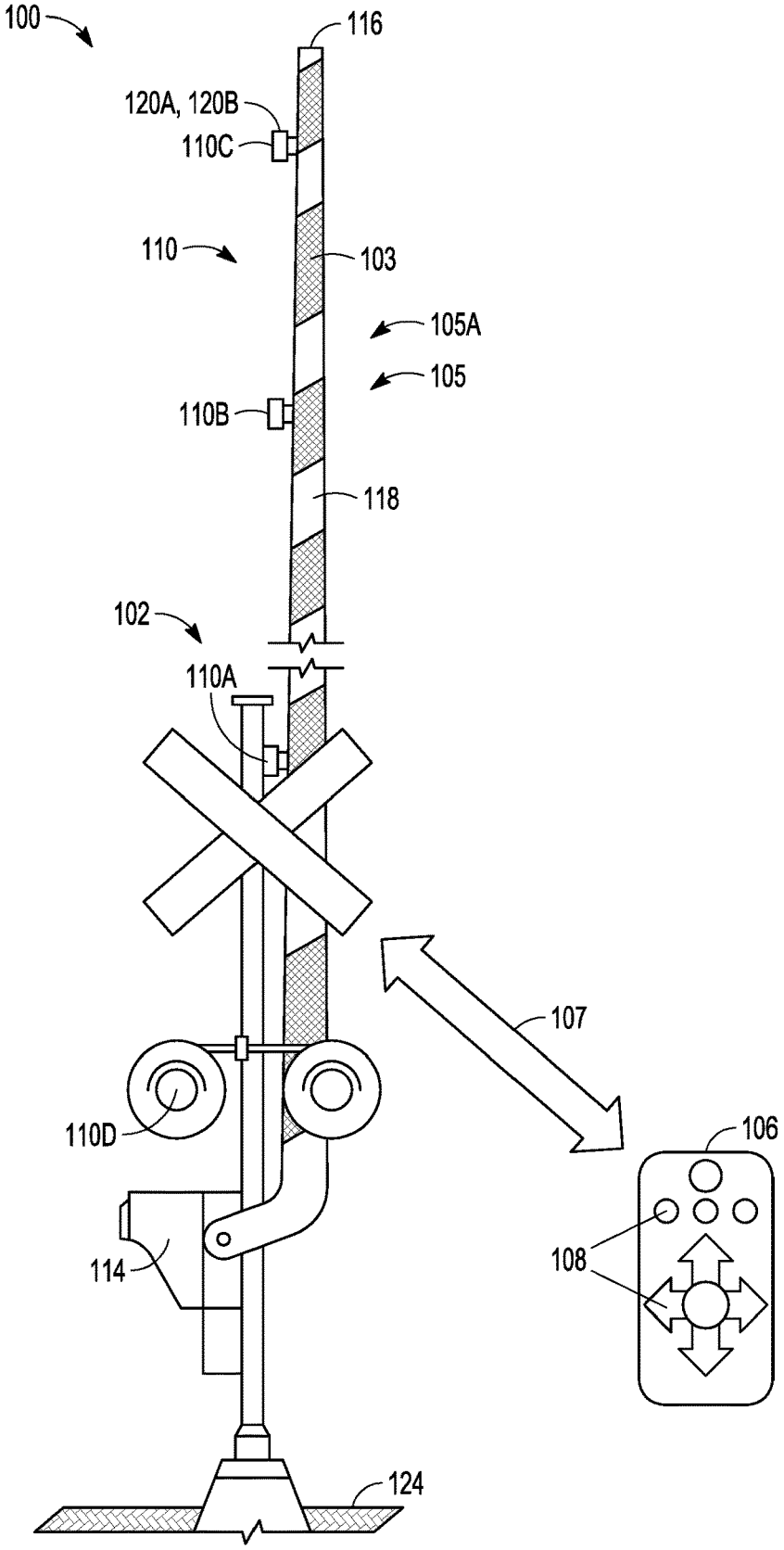
FIG. 1 is a schematic diagram of a system for setting a position and for monitoring the position of signal lights of a traffic gate according to one example embodiment.

The subject matter described herein relates to signal lights for traffic regulation (e.g., HOV lane indicator lights, traffic gate lights such as railway crossing gate lights or HOV gate lights). In particular, the present application relates to how the position of such signal lights can be set and monitored such that personnel can be alerted if the position of one or more of the signal lights changes. The present application also discusses how the position of one or more of the signal lights may be set wirelessly using a portable remote. Systems, methods, apparatuses and machine implemented solutions as described herein that may be implemented in a variety contexts (e.g., different computing environments), and are not limited to the specific embodiments described. For example, these systems and methods in other embodiments could be implemented on a mobile computing environment such as on a plurality of computing devices such as a server, a desktop personal computer, a notebook or a portable computer, smartphone, or a mainframe computer. Thus, a portable remote may not be used to set the position of the signal lights in some cases or the position of the signal lights may be monitored wirelessly or with other methodology than is specifically discussed herein.

Railroad crossing gates are in widespread use and are provided with long crossing arms for traffic barriers. The crossing arms are normally upright and are swung to a lowered, substantially horizontal position when an approaching train is detected. The crossing arms of railroad crossing gates are provided with various signal lights that are secured to the crossing arm. Conventionally, three signal lights are used on the arm. Other lights may be implements on other portions of the gate. A first light is disposed at the free end of the crossing arm. The remaining two lights are generally spaced along the crossing arm. It is conventional that the lights be incorporated into an electronic circuit such that the light at the free end is constantly illuminated when the crossing arm is in its horizontal position. The remaining signal lights are disposed in the electronic circuit such that they are flashing with the two lights alternately flashing off and on.

Similarly, HOV traffic gates and lane indicators are illuminated with signal lights. It is important with the signal lights of HOV traffic gates, lane indicator lights and railway crossing gates that the signal lights be properly oriented for maximum effectiveness in alerting the driver with a desired amount of illumination. If such signal light(s) position is changed such that they do not properly face the driver, the amount of illumination to the driver can be reduced, thereby reducing the effectiveness of the signal light(s) in alerting the driver to the presence of gate, lane, train, etc. Conventionally, the position of signal lights are not monitored. As such, railroad support personnel must inspect such signal lights periodically to insure a proper position for each signal light. Personnel must routinely inspect these signal lights at each location, perform maintenance and operational tasks. Inspection by personnel (even if re-positioning is not required) may subject them to environmental hazards (e.g., snow and ice, close proximity to operating rail lines, etc.) which pose safety issues for workers.

It should be noted that although the present application discusses specifically signal lights for railway crossing gates other signal lights such as for lane entry indicators for HOV, traffic gates for HOV, traffic diversion signal lights, stop lights, vehicle parking signal lights, etc. are contemplated as benefiting from the techniques, apparatuses, systems and methods discussed herein. Thus, the terms "signal light" and "traffic gate" as used herein should not be construed to cover only railway crossing gates. Traffic support personnel such as those from a state's DoT will also benefit from the systems, methods and apparatuses discussed herein as their exposure to potential environmental hazards will be reduced.

In view of the above, the present inventors propose systems, methods and apparatuses by which personnel can set and teach a desired light position remotely from the railway switch machine and gate location. This improves safety for personnel by reducing exposure to potential environmental hazards. Furthermore, once this desired light position (also called a reference position is set, the present inventors propose systems, methods and apparatuses by which the position of each signal light can be monitored (e.g., sensed and compared with the desired light position). This improves safety for personnel by reducing exposure to potential environmental hazards as personnel need to perform periodic signal light inspection on site.

Figure 1A:
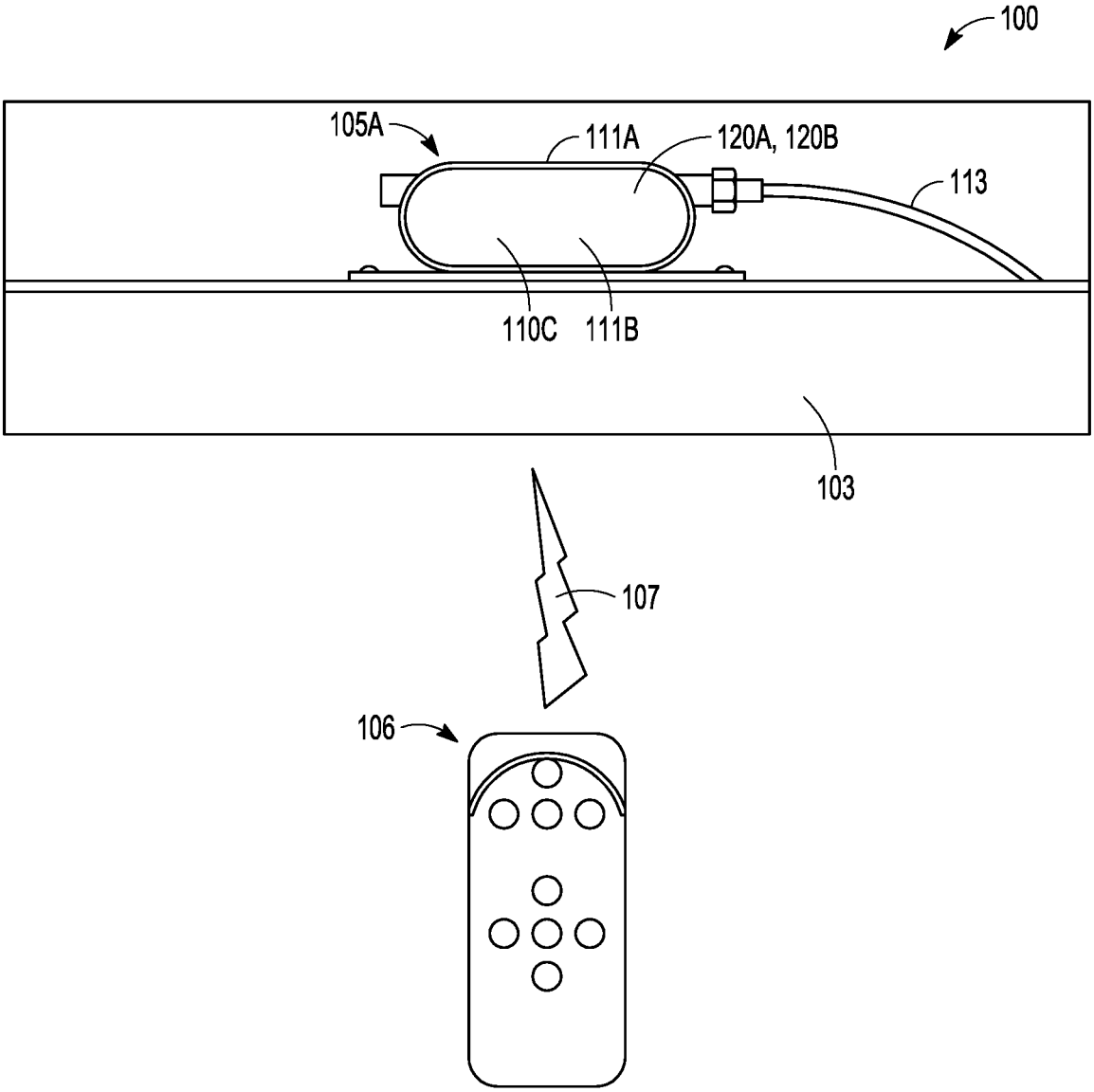
FIG. 1A is a schematic diagram of components of the system of FIG. 1.

FIG. 1 shows a system 100 according to an example embodiment. The system 100 includes a traffic gate 102 with an arm 103, an electronic circuit 105, a positioning related electronic circuit 105A, a remote device 106 and a communication system 107. The remote device 106 can include inputs 108. FIG. 1A shows certain aspects of the system 100 including a using the remote device 106 to set a desired position for a signal light 110C.

The arm 103 is moveably coupled to the remainder of the traffic gate 102 and is moveable from a raised (substantially vertical) position to a lowered (substantially horizontal) position. FIG. 1 shows arm 103 in the raised position. The electronic circuit 105 can be mounted to the traffic gate 102 including the arm 103 and can include the one or more signal lights 110. The positioning related electronic circuit 105A can include two or more sensors, a controller, memory, communication module, etc. as further discussed subsequently. The remote device 106 can communicate with the electronic circuit 105 and/or positioning related electronic circuit 105A wirelessly using the communication system 107. The remote device 106 can include the inputs 108 for the electronic circuit 105 and/or positioning related electronic circuit 105A that can change or set the operational characteristics of the system 100 including the one or more signal lights 110, to set a desired position for future reference in monitoring the position of the one or more signal lights 110, etc. as discussed subsequently. Thus, the inputs 108 can be programmed to correspond with specific operation modes, values, indicators, etc.

The traffic gate 102 includes a base 114 that is coupled to the ground or another object close to a railway 124. One or more of the one or more signal lights such as light source 110D can be mounted to the base 114. In some cases, such as with lane indicator signal lights, signal lights can be mounted adjacent the traffic gate 102. The arm 103 can be moveable from the raised position (shown in FIG. 1) to the lowered position (shown in FIG. 1A) relative to the base 114. The base 114 and/or arm 103 can optionally house or otherwise carry aspects of the electronic circuit 105A and/or positioning related electronic circuit 105A discussed subsequently. However, in other embodiments the positioning related electronic circuit 105A can be entirely mounted within or otherwise attached to or in close proximity to one or more the one or more signal lights 110. Although a single positioning related electronic circuit 105A is described herein it should be recognized that multiple of such circuits (e.g., one for each of the one or more lights sources 110) can be utilized.

Regarding the arm 103, the arm 103 can include a first end portion 116 and a second end portion 118. The second end portion 118 can be coupled to the base 114. Thus, in the raised position of FIG. 1, the first end portion 116 can be positioned above the second end portion 118. In the lowered position, the first end portion 116 and the second end portion 118 can be at substantially a similar height above one or more of the railway 124, ground, horizontal, etc.

The traffic gate 102 includes the one or more signal lights 110 (also called simply lights, lamps, diodes herein) mounted to the arm 103 and/or the base 114. FIG. 1 shows a typical railway crossing lighting scheme with three signal lights on the arm 103 indicated as 110A, 110B and 110C as well as other one signal lights 110D coupled to the base 114 of the traffic gate 102. It should be appreciated that in an alternative embodiment, any suitable number of signal lights 110 and mounted locations may be used.

According to the illustrated embodiment, the one or more signal lights 110A, 110B, 110C and 110D are EZ Gate® LED Lamps with Light Out Detection (LOD). The signal lights 110A, 110B and 110C are configured to provide light at the arm 103. It should be understood that although in the depicted embodiment the signal lights 110A, 110B, 110C and 110D are EZ Gate® LED lamps with LOD, the signal lights 110A, 110B, 110C and 110D could alternatively be any other type of light emitting diodes (LED) or a non-LED lamp such as an ordinary incandescent bulb. The electronic circuit 105 can be configured to operate the plurality of light emitting diodes based upon the switch machine utilized with the system 100.

As is further discussed herein, each or select ones of the one or more signal lights 110 can include the positioning related electronic circuit 105A coupled thereto. The positioning related electronic circuit 105A can include two or more position sensors 120A and 120B (shown for exemplary purposes in signal light 110C of FIGS. 1 and 1A for simplicity). Although aspects of the positioning related electronic circuit 105A and system 100, are described in further detail subsequently, in brief, the two or more position sensors 120A and 120B can be used together to measure a position relative to at least two axes of the signal light 110C. The position sensors 120A and 120B can be absolute position sensors or relative position sensors. For example, the first position sensor 120A can be configured to detect a first position of the signal light 110C relative to of a magnetic field of Earth. The second position sensor 120B can be configured to detect a second position of the signal light 110C relative to a gravitational field of the Earth. However, in other embodiments other position sensor types including relative position sensors such as a transducer, capacitor, displacement sensor, resistance sensor, current sensor, ultrasonic sensor, photodiode array, optical sensor, etc., are also contemplated for the position sensors 120A and 120B.

In one aspect of the present application, one of the inputs 108 of the remote device 106 can be used in conjunction with the positioning related electronic circuit 105A and the two or more sensors 120A and 120B to program the positioning related electronic circuit 105A to monitor the position relative to at least two axes of the signal light 110C. In particular, one of the inputs 108 can be actuated to indicate the signal light 110C is in a desired position. Such position can be one, for example, that has at least a majority of a face of the signal light 110C facing a viewer. Other criteria such as orientation relative to the arm, ground, roadway, railway, etc. can also be considered for setting the desired position. This signal can be utilized to teach the positioning related electronic circuit 105A that the two or more sensors 120A and 120B and the signal light 110C are in the desired position. Thus, the remote device 106 can be configured to communicate a desired position data with the positioning related electronic circuit 105A. This can be in a wired or wireless manner (although shown in a wireless manner in FIGS. 1 and 1A). The desired position data can act as a reference, indicative that the two or more sensors 120A and 120B and the signal light 110C are in the desired position. The positioning related electronic circuit 105A can be configured to store the desired positioning data for reference to determine if the position relative to at least two axes of the signal light 110C as determined by the two or more sensors 120A and 120B has changed. As used herein, the term "data" should be interpreted broadly and can include current, resistance or other criteria about the positioning related electronic circuit 105A, for example. It should be noted that because the arm 103 can be raised and lowered, resulting in a change in positioning of one of the two or more sensors 120A and 120B. However, this can be considered as not sufficient to comprise a change in the position relative to at least two axes of the signal light 110C to trigger an alert that personnel should check the positioning of the signal light 110C. Thus, only when the sensors 120A and 120B detect each detect a change in position (e.g., a change relative to gravity of Earth and a change relative to the magnetic field of the Earth, or a change relative to other criteria) would it be determined that the position relative to at least two axes of the signal light 110C has changed.

The communication system 107 between the positioning related electronic circuit 105A and the remote device 106 can be implemented using wired connection or any known wireless modality such as, but not limited to, Bluetooth, WiFi, optical (e.g., IR), RF, etc. FIGS. 1 and 1A shows the remote device 106 within range and communicating with the positioning related electronic circuit 105A. This can be by bringing the remote device 106 to within sufficient proximity of the traffic gate 102 and the one or more of the signal lights 110.

FIG. 1A shows an example where the positioning related electronic circuit 105A is mounted within the signal light 110C on the arm 103. In particular, the positioning related electronic circuit 105A can be mounted within a housing 111A of the signal light 110C. A first communication module (shown and described in FIG. 2) of the positioning related electronic circuit 105A and the system 100 can receive the signal such as to set the desired positioning data from the remote device 106 such as through a lens 111B of the signal light 110C. As will be discussed subsequently, power cable 113 for the signal light 110C can also power the positioning related electronic circuit 105A. Criteria (herein encompassed by the term "data") of the positioning related electronic circuit 105A and/or power cable 113 such as current and/or resistance can be monitored for changes therein indicative of changes of position of the sensors 120A and 120B relative to at least two axes. In some embodiments, alerts that the position of the signal light 110C has changed relative to at least two axes (as sensors 120A and 120B are housed within the signal light 110C) can be sent via the power cable 113 to a railway switch machine or another device associated with and configured to control the railway gate. The railway switch machine can be configured to alert personnel to this sensed change such that the position of the signal light 110C can be checked.

Figure 2:
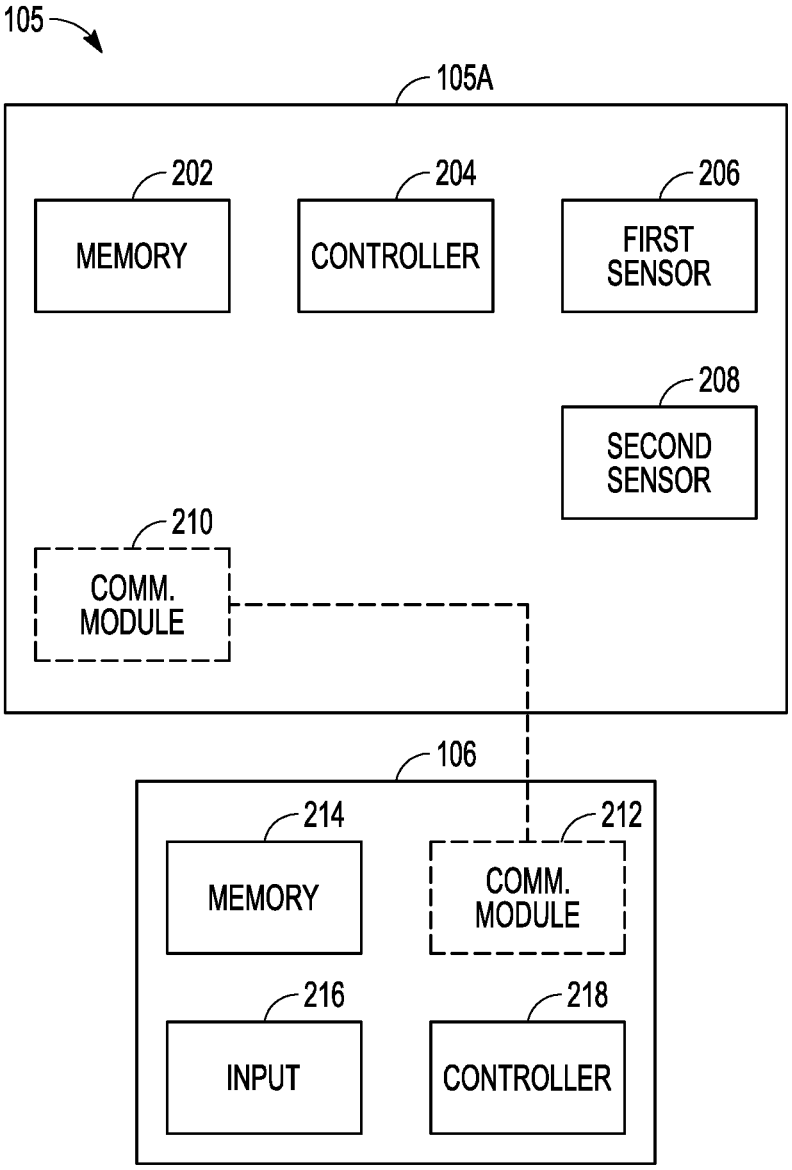
FIG. 2 illustrates exemplary hardware used to implement the system interface, according to one example embodiment.

FIG. 2 shows an example of hardware utilized by the system 100 that can comprise the positioning related electronic circuit 105A according to an example embodiment. According to some examples, various of the hardware illustrated in FIG. 2 may not be utilized or may not be part of the positioning related electronic circuit 105A in all cases. Instead aspects of the system 100 and/or the positioning related electronic circuit 105A can be implemented by other hardware, software or other known methodology. FIG. 2 shows the positioning related electronic circuit 105A and the remote device 106 as previously illustrated in FIGS. 1 and 1A.

According to the embodiment of FIG. 2, the positioning related electronic circuit 105A can include a memory 202, a controller 204, a first sensor 206, a second sensor 208 and a communication module 210. The remote device 106 can include a communication module 212, a memory 214, an input 216 and a controller 218. As described herein, the first sensor 206 corresponds with the first sensor 120A as previously described and the second sensor 208 corresponds with the second sensor 120B. It should be noted that although the controller 204 is described herein as part of the positioning related electronic circuit 105A, it is understood that in other embodiments the controller 204 can be remote from the positioning related electronic circuit 105A and can be part of another device such as a railway switch machine, a machine 400 as described in FIG. 4, or another device.

The controller 204 and the controller 218 can be embedded or integrated controllers that can be part of the system 100. The controllers 204, 218 (and indeed the positioning related electronic circuit 105A) can comprise one or more processors, microprocessors, microcontrollers, electronic control modules (ECMs), system on chip (SOC) such as application specific integrated circuit (ASIC), electronic control units (ECUs), or any other suitable means for electronically operating with the system 100 including by monitoring the signal lights position using the first sensor 206 and the second sensor 208. The controllers 204, 218 can be configured to operate according to a predetermined algorithm or set of instructions for monitoring the system 100 based on various predefined/set position characteristic(s) of signal lights 110 as previously discussed in reference to FIGS. 1 and 1A. These operating characteristics can be based on, for example, input (e.g., data such as current or resistance, etc.) from the first sensor 206, input (data such as current or resistance, etc.) from the second sensor 208, input (data) from inputs 108, etc. As discussed previously, the predefined/set desired position characteristic (s)/data of signal light(s) 110 can be compared to updated data from the first sensor 206 and the second sensor 208 to determine if a position change with respect to at least two or more axes has occurred for the signal light(s) 110.

The algorithms or set of instructions utilized by one or more of the controllers 204, 218 comprising the predefined/set desired position characteristic(s)/data of signal lights 110 can be stored in a database, can be read into on-board memory, or can be preprogrammed into memory module 202 and/or memory module 214. The memory module 202 and/or memory module 214 can be in the form of a hard drive, jump drive, optical medium, random access memory (RAM), read-only memory (ROM), removable memory card such as micro-SD, or any other suitable computer readable storage medium commonly used in the art.

The first sensor 206 and the second sensor 208 can be in electrical communication or connected to the controller 204 and/or the controller 218. The first sensor 206 and the second sensor 208 can include instructions, etc. for interpreting data from or otherwise communicating with the controller 204, in some cases. However, this is not contemplated in all embodiments and varying levels of complexity and capability for the first sensor 206 and the second sensor 208 are contemplated herein.

The communication modules 210 and 212 are configured to enable wireless communication from the remote device 105 to the electronic circuit 106. In some embodiments, communication can be between (back and forth) the remote device 105 and the electronic circuit 106. The communication modules 210 and 212 can be an optical module (e.g., IR module), an integrated RF module, a card-connected RF module, etc. An example of a card-connected RF module is an XBee RF Module available from Digi International® Inc. (Digi®) of Minnetonka, Minnesota, such as model number XB24-Z7PIT-004, which operates in a frequency band of 2.4

GHz, has a line of sight range of 120 meters, can communicate at a rate of 250 Kbps. According to one example, the communication module 210 comprises an optical receiver and the communication module 212 comprises an optical transmitter. According to another example, the communication module 210 comprises a radio frequency receiver and the communication module 212 comprises a radio frequency transmitter. The input module 218 can be configured to receive input from inputs 108 (FIG. 1) and can communicate such data to the controller 218. A further communication module such as one that communicates with the railway switch machine wireless or via wired connection (such as via the power cable 113) can also be utilized with the system 100 but is not specifically shown herein.

Figure 3:
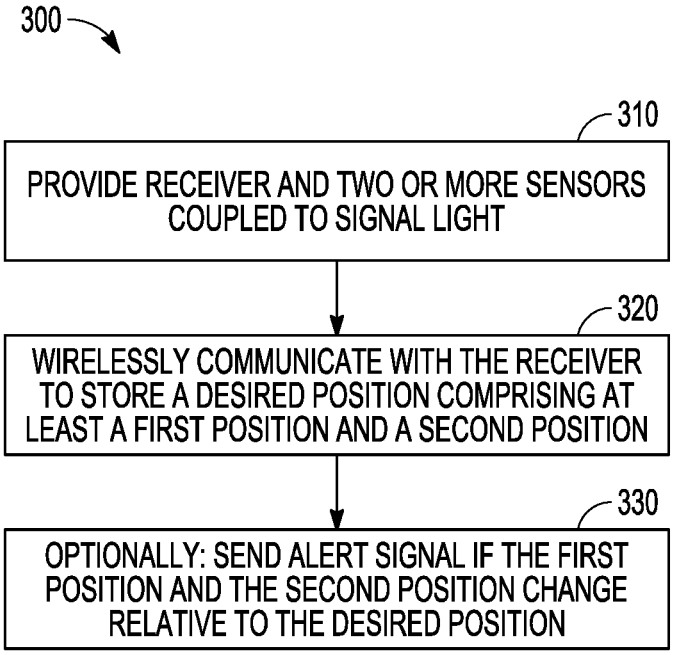
FIG. 3 illustrates a method for wireless control of signal lights of the traffic gate, according to one example embodiment.

FIG. 3 illustrates an example method 300. The operations of method 300 may be performed in whole or part by one or more components or systems described above with respect to FIGS. 1-2. At operation 310, the method 300 can provide a receiver and two or more position sensors are coupled to signal light for regulating traffic. At operation 320, the method can wirelessly communicate with the receiver to store as a reference, a desired position that can comprises at least a first position and a second position detected by the two or more position sensors.

According to some examples, the method 300 can further send an alert signal if the first position and the second position detected by the two or more position sensors changes relative to the desired position. In some cases, wirelessly communicating with the receiver includes operating a portable remote electronically coupled to an optical transmitter to communicate with the receiver through a lens of the signal light. The two or more position sensors and the receiver can be mounted to an electronic circuit board positioned within a housing of the signal light. The first position sensor can be configured to detect the first position relative to of a magnetic field of Earth, and the second position sensor can be configured to detect the second position relative to a gravitational field of the Earth.

Railroad support personnel may connect to the receiver to set the desired position for the signal light. Thus, at operation 320, such connection can be used to store as the reference, the desired position that can comprises at least a first position and a second position detected by the two or more position sensors. Optionally, at operation 330, data (comprising the alert) can be communicated to the personnel regarding the position sensors. The data can be indicative that the position sensors have changed position relative to the desired position Although embodiments have been described in language specific to structural features and/or methods, it is to be understood that the invention is not necessarily limited to the specific features or methods described. Rather, the specific features and methods are disclosed as exemplary implementations.

Figure 4:
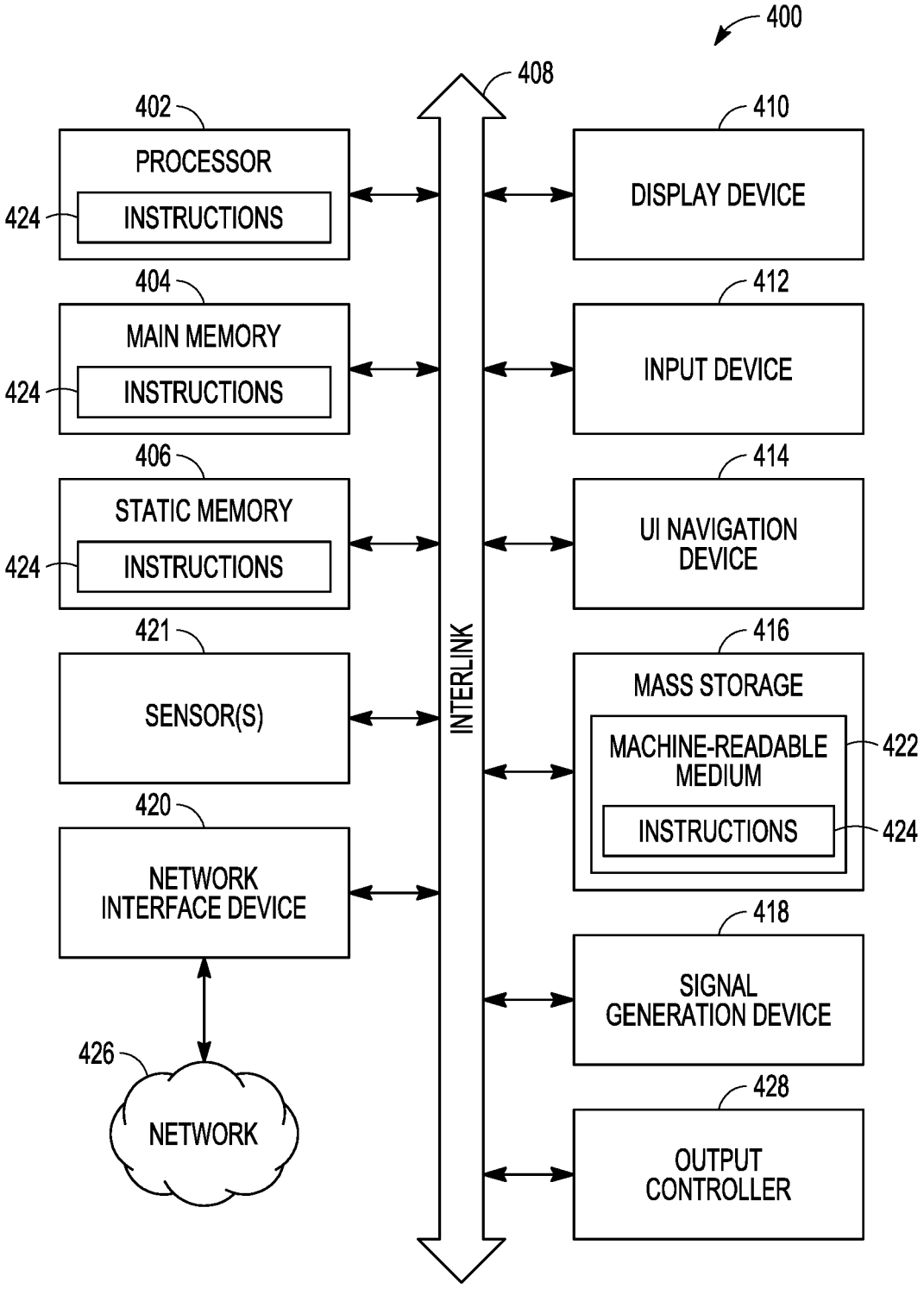
FIG. 4 is a block diagram illustrating an example of a machine upon which one or more embodiments may be implemented.

FIG. 4 illustrates a block diagram of an example machine 400 upon which any one or more of the, systems, methods or techniques (e.g., methodologies) discussed herein may perform. In alternative embodiments, the machine 400 may operate as a standalone device or may be connected (e.g., networked) to other machines. In a networked deployment, the machine 400 may operate in the capacity of a server machine, a client machine, or both in server-client network environments. In an example, the machine 400 may act as a peer machine in peer-to-peer (P2P) (or other distributed) network environment. The machine 400 may be a personal computer (PC), a tablet PC, a Personal Digital Assistant (PDA), a mobile telephone, smartphone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" or "controller" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 400 may include a hardware processor 402 (e.g., a central processing unit (CPU), a graphics processing unit (GPU), a hardware processor core, or any combination thereof), a main memory 404 and a static memory 406, some or all of which may communicate with each other via an interlink (e.g., bus) 408. The machine 400 may further include a display unit 410, an alphanumeric input device 412 (e.g., a keyboard), and a user interface (UI) navigation device 414 (e.g., a mouse). In an example, the display unit 410, input device 412 and UI navigation device 414 may be a touch screen display. The machine 400 may additionally include a storage device (e.g., drive unit) 416, a signal generation device 418 (e.g., a transmitter), a network interface device 420, and sensors 421, etc. The machine 400 may include an output controller 428, such as a serial (e.g., universal serial bus (USB), parallel, or other wired or wireless (e.g., infrared (IR)) connection to communicate or control one or more devices (e.g., the one or more signal lights 110 of FIGS. 1 and 1A.).

The storage device 416 may include a machine readable medium 422 on which is stored one or more sets of data structures or instructions 424 (e.g., software) embodying or utilized by any one or more of the techniques or functions described herein. The instructions 424 may also reside, completely or at least partially, within the main memory 404, within static memory 406, or within the hardware processor 402 during execution thereof by the machine 400. In an example, one or any combination of the hardware processor 402, the main memory 404, the static memory 406, or the storage device 416 may constitute machine readable media.

While the machine readable medium 422 is illustrated as a single medium, the term "machine readable medium" may include a single medium or multiple media (e.g., a centralized or distributed database, and/or associated caches and servers) that arranged to store the one or more instructions 424.

The term "machine readable medium" may include any medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine readable medium examples may include solid-state memories and optical and magnetic media. In an example, a massed machine readable medium comprises a machine readable medium with a plurality of particles having resting mass. Specific examples of massed machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 424 may further be transmitted or received over a communications network 426 using a transmission medium via the network interface device 420 (i.e. a communication device) utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, wireless data networks (e.g., Institute of Electrical and Electronics Engineers (IEEE) 802.11 family of standards known as Wi-Fi®, and IEEE 802.16 family of standards known as WiMax®), and peer-to-peer (P2P) networks, Bluetooth, among others. In an example, the network interface device 420 may include one or more physical jacks (e.g., Ethernet, coaxial, or phone jacks) or one or more antennas to connect to the communications network 426. In an example, the network interface device 420 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 400, and includes digital or analog communications signals or other intangible medium to facilitate communication of such software.

Additional Notes & Examples

Example 1 is a system that can optionally comprise one or more of: a signal light for regulating traffic, a controller, a first communication module configured to electronically communicate with the controller, two or more position sensors coupled to the signal light, wherein the two or more position sensors comprise at least a first position sensor configured to detect a first position of the signal light according to a first measurable criteria and a second position sensor configured to detect a second position of the signal light according to a second measurable criteria, and a memory configured to selectively store as a reference, desired position data corresponding to the first position and the second position based upon a signal received by the first communication module. The controller can be configured to electronically communicate with the two or more position sensors to receive an updated data regarding the first position and the second position and is configured to compare the updated data to the desired position data.

Example 2 is the system of Example 1, where the controller can be configured to communicate an alert signal if the updated data has changed relative to desired position data.

Example 3 is the system of Example 2, wherein the alert signal can be transmitted one of wirelessly or via a power cable supplying power to the signal light.

Example 4 is the system of any one or any combination of Examples 1-3, where the first communication module optionally can comprise an optical receiver configured to optically communicate with a portable optical transmitter through a lens of the signal light.

Example 5 is the system of any one or any combination of Examples 1-4, where the desired position data can optionally comprise at least one of a current or resistance level, and wherein the updated data comprises at least one of a current or resistance level.

Example 6 is system of any one or any combination of Examples 1-3 or 5, where the first communication module optionally can comprise a radio frequency receiver configured to electronically communicate with a portable radio frequency transmitter.

Example 7 is the system of any one or any combination of Examples 1-6, where the controller can be configured to electronically communicate with the two or more position sensors one of continuously or periodically.

Example 8 is the system of any one or any combination of Examples 1-7, where the controller, the two or more position sensors and the first communication module can be part of an electronic circuit board configured to mount within a housing of the signal light.

Example 9 is the system of any one or any combination of Examples 1-8, further optionally comprising a traffic gate having an arm, wherein the signal light can be configured to couple to the arm or another portion of the traffic gate.

Example 10 is the system of any one or any combination of Examples 1-9, wherein the first position sensor can optionally be configured to detect the first position relative to of a magnetic field of Earth, and wherein the second position sensor can optionally be configured to detect the second position relative to a gravitational field of the Earth.

Example 11 is a method that can optionally include providing a receiver and two or more position sensors coupled to signal light for regulating traffic, and wirelessly communicating with the receiver to store as a reference, a desired position comprising at least a first position and a second position detected by the two or more position sensors.

Example 12 is the method of Example 11, optionally further comprising sending an alert signal if the first position and the second position detected by the two or more position sensors changes relative to the desired position.

Example 13 is the method of any one or any combination of Examples 11-12, where wirelessly communicating with the receiver can optionally include operating a portable remote electronically coupled to an optical transmitter to communicate with the receiver through a lens of the signal light.

Example 14 is the method of any one or any combination of Examples 11-13, where the two or more position sensors and the receiver can optionally be mounted to an electronic circuit board positioned within a housing of the signal light.

Example 15 is the method of any one or any combination of Examples 11-14, where the first position sensor can be configured to detect the first position relative to of a magnetic field of Earth, and where the second position sensor can be configured to detect the second position relative to a gravitational field of the Earth.

Example 16 is computer-readable medium comprising instructions that, when executed by a machine, can optionally cause the machine to: communicate wirelessly using a receiver and a transmitter to set a reference, a desired position of a signal light for regulating traffic, wherein the desired position is detected by a least a first position sensor and a second position sensor, monitor the first position sensor and the second position sensor; and send an alert signal if a first position and a second position detected by the first position sensor and the second position sensor, respectively, changes relative to the desired position.

Example 17 is the computer-readable medium of Example 16, wherein the receiver can be part of an electronic circuit board that includes the two or more sensors and can be positioned within a housing of the signal light.

Example 18 is the computer-readable medium of Example 17, where the receiver can comprise an optical receiver configured to communicate optically through a lens of the signal light with the transmitter.

Example 19 is the computer-readable medium of any one or any combination of Examples 16-18, wherein the first position sensor can be configured to detect the first position relative to of a magnetic field of Earth, and wherein the second position sensor can be configured to detect the second position relative to a gravitational field of the Earth.

Example 20 is an apparatus that can include any one or combination of a housing, one or more light emitting diodes positioned within the housing, a lens positioned adjacent the one or more light emitting diodes and coupled to the housing, an electronic circuit board positioned within the housing, the electronic circuit board can optionally comprise any one or combination of: a controller, two or more position sensors, wherein the two or more position sensors comprise at least a first position sensor configured to detect a first position of the signal light according to a first measurable criteria and a second position sensor configured to detect a second position of the signal light according to a second measurable criteria, and a memory configured to selectively store as a reference, at least one of a current or resistance corresponding to the first position and the second position. The controller can optionally be configured to electronically communicate with the two or more position sensors to receive updated at least one of current or resistance corresponding to the first position and the second position and is configured to compare the updated at least one of the current or resistance to the at least one of the current or resistance.

The above detailed description includes references to the accompanying drawings, which form a part of the detailed description. The drawings show, by way of illustration, specific embodiments in that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure, for example, to comply with 37 C.F.R. § 1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A system comprising:

a signal light for regulating traffic;

a controller;

a first communication module configured to electronically communicate with the controller;

two or more position sensors coupled to the signal light, wherein the two or more position sensors comprise at least a first position sensor configured to detect a first position of the signal light according to a first measurable criteria and a second position sensor configured to detect a second position of the signal light according to a second measurable criteria; and a memory configured to selectively store as a reference, desired position data corresponding to the first position and the second position based upon a signal received by the first communication module;

wherein the controller is configured to electronically communicate with the two or more position sensors to receive an updated data regarding the first position and the second position and is configured to compare the updated data to the desired position data.

2. The system of claim 1, wherein the controller is configured to communicate an alert signal if the updated data has changed relative to desired position data.

3. The system of claim 2, wherein the alert signal is transmitted one of wirelessly or via a power cable supplying power to the signal light.

4. The system of claim 1, wherein the first communication module comprises an optical receiver configured to optically communicate with a portable optical transmitter through a lens of the signal light.

5. The system of claim 1, wherein the desired position data comprises at least one of a current or resistance level, and wherein the updated data comprises at least one of a current or resistance level.

6. The system of claim 1, wherein the first communication module comprises a radio frequency receiver configured to electronically communicate with a portable radio frequency transmitter.

7. The system of claim 1, wherein the controller is configured to electronically communicate with the two or more position sensors one of continuously or periodically.

8. The system of claim 1, wherein the controller, the two or more position sensors and the first communication module are part of an electronic circuit board configured to mount within a housing of the signal light.

9. The system of claim 1, further comprising a traffic gate having an arm, wherein the signal light is configured to couple to the arm or another portion of the traffic gate.

10. The system of claim 1, wherein the first position sensor is configured to detect the first position relative to of a magnetic field of Earth, and wherein the second position sensor is configured to detect the second position relative to a gravitational field of the Earth.

11. The system of claim 1, wherein the signal light comprises:

a housing;

one or more light emitting diodes positioned within the housing;

a lens positioned adjacent the one or more light emitting diodes and coupled to the housing;

an electronic circuit board positioned within the housing, the electronic circuit board comprising:

the controller;

the two or more position sensors; and the memory configured to selectively store as a reference, at least one of a current or resistance corresponding to the first position and the second position;

wherein the controller is configured to electronically communicate with the two or more position sensors to receive updated at least one of current or resistance corresponding to the first position and the second position and is configured to compare the updated at least one of the current or resistance to the at least one of the current or resistance.

12. A method comprising:

providing a receiver and two or more position sensors coupled to signal light for regulating traffic; and wirelessly communicating with the receiver to store as a reference, a desired position comprising at least a first position and a second position detected by the two or more position sensors, wherein the first position sensor is configured to detect the first position relative to of a magnetic field of Earth. and wherein the second position sensor is configured to detect the second position relative to a gravitational field of the Earth.

13. The method of claim 12, further comprising sending an alert signal if the first position and the second position detected by the two or more position sensors changes relative to the desired position.

14. The method of claim 12, wherein wirelessly communicating with the receiver includes operating a portable remote electronically coupled to an optical transmitter to communicate with the receiver through a lens of the signal light.

15. The method of claim 12, wherein the two or more position sensors and the receiver are mounted to an electronic circuit board positioned within a housing of the signal light.

16. A computer-readable medium comprising instructions that, when executed by a machine, cause the machine to:

communicate wirelessly using a receiver and a transmitter to set a reference, a desired position of a signal light for regulating traffic, wherein the desired position is detected by a least a first position sensor and a second position sensor, wherein the receiver comprises an optical receiver configured to communicate optically through a lens of the signal light with the transmitter:

monitor the first position sensor and the second position sensor; and send an alert signal if a first position and a second position detected by the first position sensor and the second position sensor, respectively, changes relative to the desired position.

17. The computer-readable medium of claim 16, wherein the receiver is part of an electronic circuit board that includes the first position sensor and the second position sensor and is positioned within a housing of the signal light.

18. The computer-readable medium of claim 16, wherein the first position sensor is configured to detect the first position relative to of a magnetic field of Earth, and wherein the second position sensor is configured to detect the second position relative to a gravitational field of the Earth.

* * * * *